US008643299B2

(12) United States Patent
Jee et al.

(10) Patent No.: US 8,643,299 B2
(45) Date of Patent: Feb. 4, 2014

(54) LED LAMP AND DRIVING CIRCUIT FOR THE SAME

(75) Inventors: Yong Keun Jee, Gyunggi-do (KR); Byung Kwan Song, Gyunggi-do (KR); Yun Whan Na, Gyunggi-do (KR); Jin Jong Kim, Gyunggi-do (KR); Sun Woo Im, Gyeongsangnam-do (KR); Seok Kyu Kim, Incheon (KR); Hyun Kyung Kim, Gyunggi-do (KR)

(73) Assignee: Samsung Electronics Co., Ltd., Seoul (KR)

( * ) Notice: Subject to any disclaimer, the term of this patent is extended or adjusted under 35 U.S.C. 154(b) by 120 days.

(21) Appl. No.: 13/078,396

(22) Filed: Apr. 1, 2011

(65) Prior Publication Data

US 2012/0038289 A1 Feb. 16, 2012

(30) Foreign Application Priority Data

Aug. 11, 2010 (KR) ..... 10-2010-0077571

(51) Int. Cl.
*H05B 37/02* (2006.01)
*F21V 19/00* (2006.01)

(52) U.S. Cl.
USPC ..... 315/291; 315/294; 315/307; 362/382; 362/646; 362/294

(58) Field of Classification Search
USPC ..... 315/200 R, 291, 294, 307, 224, 247, 315/200 A; 362/382, 231, 243, 247, 297, 362/632, 612, 555, 582, 580, 294
See application file for complete search history.

(56) References Cited

U.S. PATENT DOCUMENTS

| | | | | |
|---|---|---|---|---|
| 5,834,924 | A * | 11/1998 | Konopka et al. | 323/222 |
| 8,143,769 | B2 * | 3/2012 | Li | 313/46 |
| 8,269,428 | B2 * | 9/2012 | Broitzman | 315/294 |
| 8,342,733 | B2 * | 1/2013 | Daily et al. | 362/646 |
| 2008/0165538 | A1 * | 7/2008 | Callahan | 362/296 |
| 2010/0117553 | A1 | 5/2010 | Lee | |
| 2010/0264845 | A1 * | 10/2010 | Broitzman | 315/294 |
| 2011/0121726 | A1 * | 5/2011 | Erchak et al. | 315/32 |
| 2011/0148325 | A1 * | 6/2011 | Trovo' | 315/307 |
| 2011/0204779 | A1 * | 8/2011 | Shum et al. | 315/35 |

FOREIGN PATENT DOCUMENTS

| | | | |
|---|---|---|---|
| CN | 101483947 | A | 7/2009 |
| KR | 10-2009-087677 | | 8/2009 |
| KR | 10-2009-115656 | | 11/2009 |
| KR | 10-2010-068228 | | 6/2010 |
| WO | 2010/050659 | A1 | 5/2010 |

OTHER PUBLICATIONS

Notification of First Office Action Chinese Patent Application No. 201110174628.X dated Aug. 2, 2013 w/English translation.

* cited by examiner

*Primary Examiner* — Vibol Tan
(74) *Attorney, Agent, or Firm* — McDermott Will & Emery LLP

(57) ABSTRACT

An LED lamp driving circuit includes: a thermistor having one terminal through which an external voltage is applied; an AC-DC conversion unit connected to the other terminal of the thermistor and converting an AC voltage applied to the other terminal of the thermistor into a DC voltage; and a DC-DC conversion unit converting the DC voltage from the AC-DC conversion unit into a DC voltage required to drive the LED lamp.

10 Claims, 10 Drawing Sheets

LED LAMP AND DRIVING CIRCUIT FOR THE SAME

CROSS-REFERENCE TO RELATED APPLICATIONS

This application claims the priority of Korean Patent Application No. 2010-0077571 filed on Aug. 11, 2010, in the Korean Intellectual Property Office, the disclosure of which is incorporated herein by reference.

BACKGROUND OF THE INVENTION

1. Field of the Invention

The present invention relates to a light emitting diode (LED) lamp and a driving circuit for the same, and more particularly, to an LED lamp which can stably drive an LED by ensuring compatibility between a halogen lamp stabilizer and an LED lamp, and an LED lamp which can improve the connection between an LED package board and a control circuit board for driving an LED.

2. Description of the Related Art

In general, a halogen lamp is a type of incandescent lamp and is a lamp in which a halogen material is injected into a glass bulb to suppress the evaporation of tungsten. Such a halogen lamp is brighter and has a longer service life, as compared to an incandescent lamp. Hence, a halogen lamp is widely used as stage lighting or as an interior lighting source. However, since a halogen lamp consumes a large amount of power and generates a large amount of heat, it often causes safety accidents such as fires or burns. Therefore, a halogen lamp has recently been replaced with an LED lamp which consumes a small amount of power, generates a small amount of heat, and has a superior light emitting efficiency.

Since a conventional halogen lamp uses a dedicated stabilizer and a typical LED lamp uses a dedicated stabilizer such as an SMPS, compatibility between the halogen lamp and the LED lamp is lowered. That is, in a case in which a halogen light source is replaced with an LED and a halogen lamp stabilizer is used in an LED lamp, flickering occurs and elements included in a driving circuit are damaged by high heat. In addition, LEDs are damaged due to high heat, thus reducing a life span of LEDs. To solve these problems, a dedicated LED stabilizer is added or a new halogen lamp stabilizer is designed. However, the installation of a new stabilizer or the repair of a conventional stabilizer incurs additional expenses.

In addition, in structural terms, when an LED package board on which LEDs are mounted is connected to a control circuit board on which an LED driving circuit is mounted, electrical interconnections through a soldering process using wires or harnesses are required. Thus, a manufacturing process and a circuit configuration become complicated, causing degradation in the reliability thereof.

SUMMARY OF THE INVENTION

An aspect of the present invention provides an LED lamp which can stably drive an LED by ensuring compatibility between a halogen lamp stabilizer and an LED lamp, and an LED lamp which can improve the connection between an LED package board and a control circuit board for driving an LED.

An aspect of the present invention also provides an LED lamp driving circuit including: a thermistor having one terminal through which an external voltage is applied; an AC-DC conversion unit connected to the other terminal of the thermistor and converting an AC voltage applied to the other terminal of the thermistor into a DC voltage; and a DC-DC conversion unit converting the DC voltage from the AC-DC conversion unit into a DC voltage required to drive the LED lamp.

The thermistor may be connected to an external voltage supplied from a halogen lamp stabilizer.

The DC-DC conversion unit may be implemented in one of a boost type, a buck type, and a buck-boost type.

The DC-DC conversion unit may be connected to an LED module including at least one LED.

According another aspect of the present invention, there is provided an LED lamp including: an LED package board on which at least one LED is mounted; a control circuit board on which a control circuit required to operate the LED is mounted, terminals to be electrically connected to the LED being provided at a side of the control circuit board; and a card edge connector connecting the LED package board and the control circuit board, the card edge connector including a groove into which the terminals of the control circuit board are inserted.

Terminals to be electrically connected to the terminals of the control circuit board may be provided within the groove of the card edge connector.

One side of the card edge connector may be connected to the LED package board, and the other side of the card edge connector may be connected to the control circuit board, whereby the LED and the LED control circuit are electrically connected together.

The card edge connector may further include a protrusion within the groove, and the protrusion fixes the control circuit board by adjusting the height of the protrusion according to the thickness of the control circuit board inserted into the card edge connector.

The LED lamp may further include a heat sink between the LED package board and the control circuit board.

The LED lamp may further include a connection pin which is provided at a side of the control circuit board and is to be connected to an external connection terminal.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
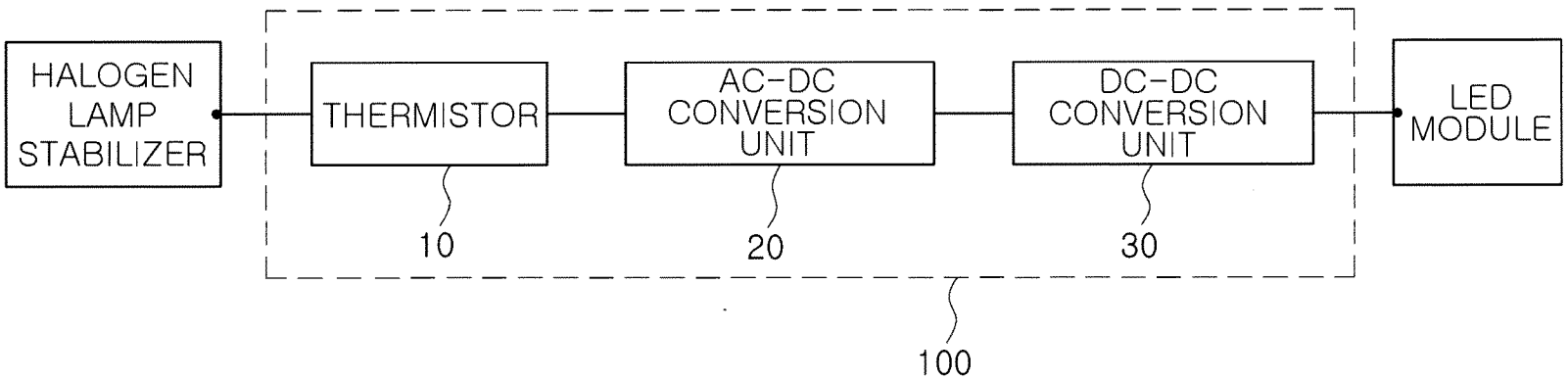
FIG. 1 is a block diagram of an LED lamp driving circuit according to an embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the thicknesses of layers and regions are exaggerated for clarity. Like reference numerals in the drawings denote like elements, and thus their description will be omitted.

FIG. 1 is a block diagram of an LED lamp driving circuit according to an embodiment of the present invention. Referring to FIG. 1, the LED lamp driving circuit 100 includes a thermistor 10, an AC-DC conversion unit 20, and a DC-DC conversion unit 30. The LED lamp driving circuit 100 drives an LED module by an external voltage. The external voltage may be a voltage applied from a halogen lamp stabilizer, and the LED lamp driving circuit 100 may be used as a circuit for driving an LED lamp replacing a conventional halogen lamp. That is, the LED lamp driving circuit 100 may operate using a conventional halogen lamp stabilizer.

Specifically, the LED lamp driving circuit 100 includes the thermistor 10 connected to the external voltage supplied from the halogen lamp stabilizer or the like. The thermistor 10 prevents an instantaneous overcurrent by limiting an inrush current when an initial voltage is applied. Thus, the circuit elements can be protected and the compatibility with the halogen lamp stabilizer connected to the external voltage can be ensured. The thermistor 10 will be described below in detail. The AC-DC conversion unit 20 is connected to the thermistor 10 and converts an AC voltage inputted from the thermistor 10 into a DC voltage. The DC-DC conversion unit 30 receives the DC voltage from the AC-DC conversion unit 20 and converts the DC voltage into a DC voltage suitable for LED driving.

The selection and mutual connection of the DC-DC conversion unit 20 are determined depending on whether the input voltage to be converted is higher or lower than a voltage required to drive an LED at a desired operation current or the input voltage changes from a high level to a low level. As one example, a buck converter may be used when the input voltage is higher than the LED voltage, and a boost converter maybe used when the input voltage is lower than the LED voltage. A buck-boost converter may be used when the input voltage changes from a high level to a low level.

Figure 2:
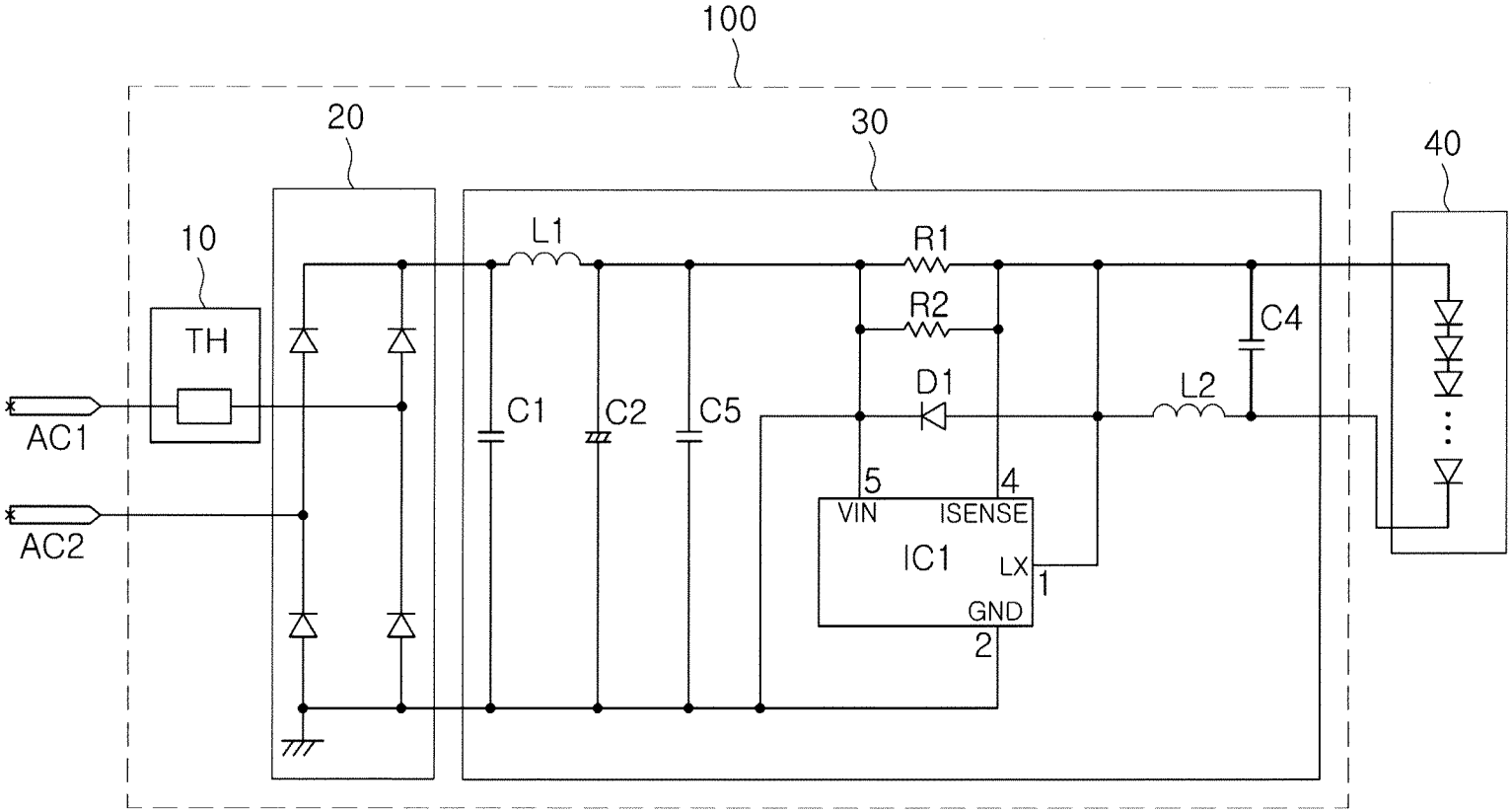
FIG. 2 is a circuit diagram of the LED lamp driving circuit according to an embodiment of the present invention.

FIG. 2 is a circuit diagram of the LED lamp driving circuit according to an embodiment of the present invention. Referring to FIG. 2, external voltages AC1 and AC2 are connected to one side of the LED lamp driving circuit 100, and the LED module 40 is connected to the other side of the LED lamp driving circuit 100. The external voltages AC1 and AC2 maybe voltages inputted from the halogen lamp stabilizer. The LED lamp driving circuit 100 includes the thermistor 10 connected to the external voltages AC1 and AC2, the AC-DC conversion unit 20 connected to the thermistor 10, and the DC-DC conversion unit 30 connected to the AC-DC conversion unit 20. In this embodiment, the DC-DC conversion unit 30 uses a non-isolation type buck converter. However, as described above, the DC-DC conversion unit 30 may be changed depending on a voltage required to drive the LED at a desired operating current.

Hereinafter, the characteristics of the LED lamp for replacing the conventional halogen lamp stabilizer will be described in order to explain the characteristics of the LED driving circuit 100 according to the embodiment of the present invention.

Figure 3:
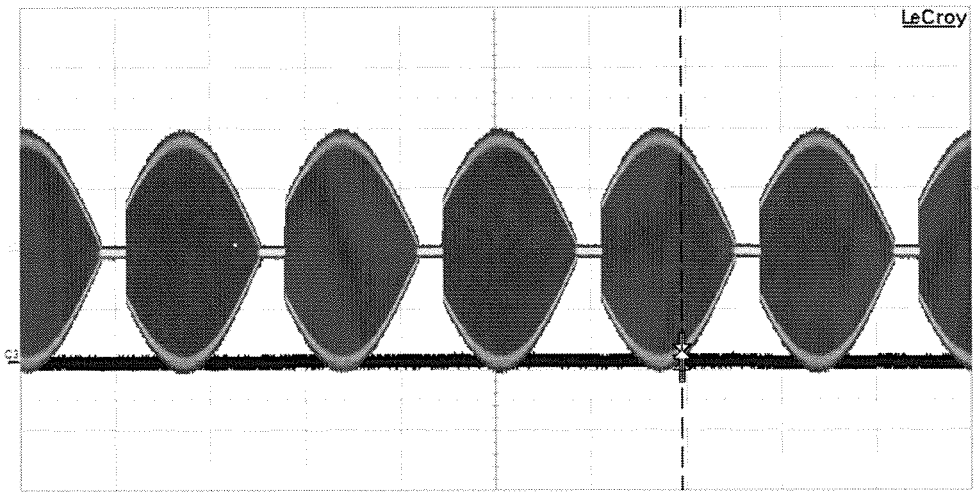
FIG. 3 is an output waveform diagram of a halogen lamp stabilizer when a halogen lamp is applied to a conventional halogen lamp stabilizer.

FIG. 3 is an output waveform diagram of a halogen lamp stabilizer when a halogen lamp is applied to a conventional halogen lamp stabilizer. Since the halogen lamp operates with an AC voltage, an output signal having an output voltage suitable for driving the halogen lamp (for example, 12 V) is generated. FIG. 3 shows the output voltage of the halogen lamp stabilizer when pulse width modulation (PWM) switching is performed at a frequency of 50 kHz. The output voltage of the halogen lamp stabilizer is 12 Vrms. In this case, the AC-DC conversion unit converting the AC voltage into the DC voltage is required in order to receive the AC output voltage of the halogen lamp stabilizer and drive the LED module. As illustrated in FIG. 3, a smoothing capacitor is required in order to remove an off period occurring within the waveform.

Figure 4A:
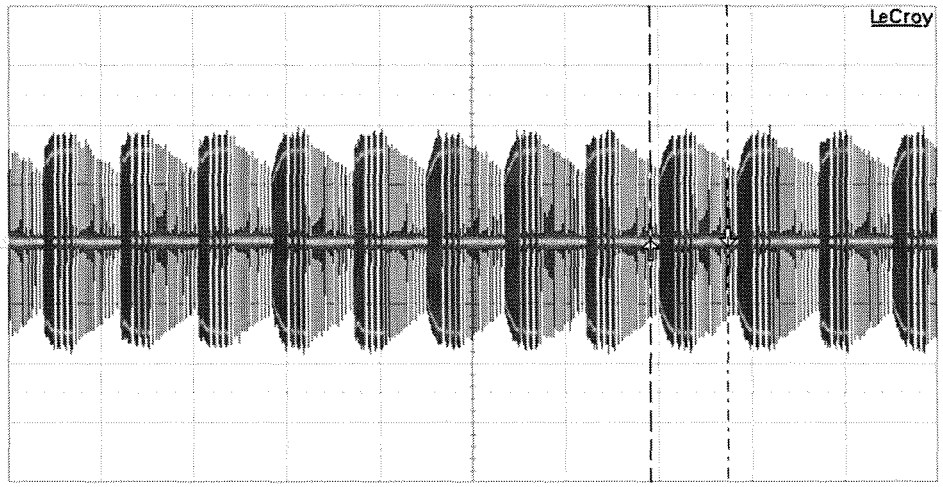
FIGS. 4A and 4B are output waveform diagrams of a halogen lamp stabilizer when an LED lamp is applied to a conventional halogen lamp stabilizer.
Figure 4B:
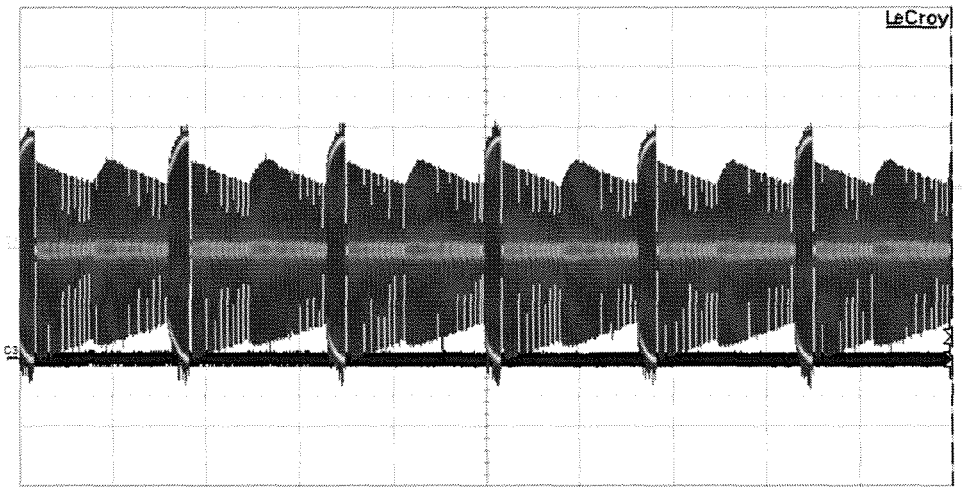

FIGS. 4A and 4B are output waveform diagrams of a halogen lamp stabilizer when an LED lamp is applied to a conventional halogen lamp stabilizer. Specifically, FIGS. 4A and 4B illustrate output waveforms of the halogen lamp stabilizer when the same LED lamps are applied to halogen lamp stabilizers manufactured by different manufacturers. As illustrated, it is difficult to ensure compatibility due to different stabilizer output waveforms, and there may occur a period in which the output voltage of the halogen lamp does not reach the LED lamp driving voltage. When the inputted minimum voltage does not reach the LED lamp driving voltage, the LED may not be turned on, or flickering may occur.

Figure 5A:
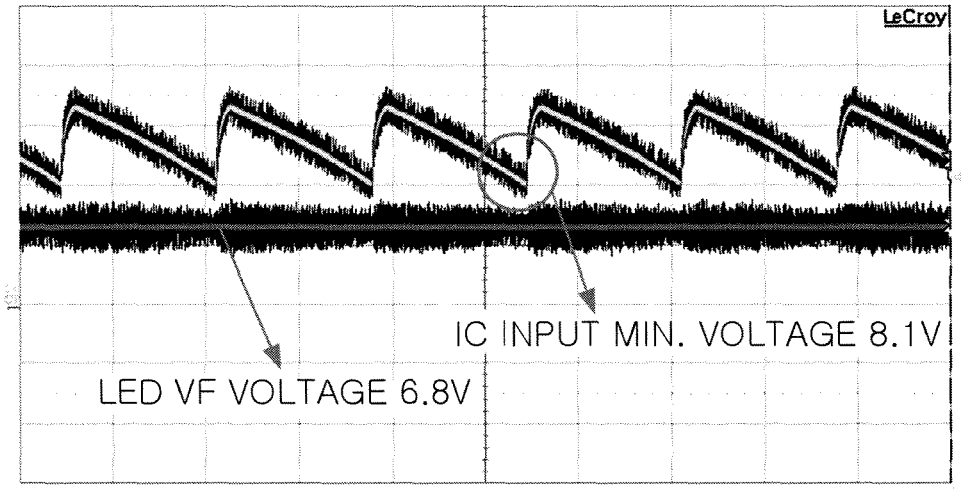
FIGS. 5A and 5B are output waveform diagrams of a halogen lamp stabilizer according to a capacitance of an input capacitor.
Figure 5B:
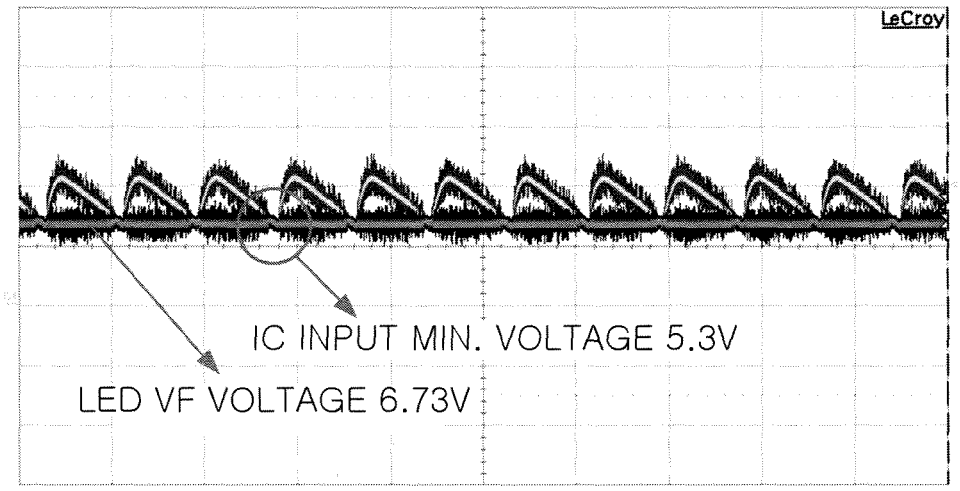

To prevent such a phenomenon, it is necessary to raise the minimum voltage of the stabilizer output voltage. The minimum voltage of the stabilizer output voltage may be raised by increasing a capacitance of an input capacitor. FIGS. 5A and 5B are output waveform diagram of the halogen lamp stabilizer according to the capacitance of the input capacitor. Specifically, FIG. 5A illustrates the output waveform of the halogen lamp stabilizer when the capacitance of the input capacitor is increased, and FIG. 5B illustrates the output waveform of the input capacitor when the capacitance of the input capacitor is decreased. When the capacitance of the input capacitor is increased (FIG. 5A), the minimum output voltage (about 8.1 V) of the halogen lamp stabilizer is higher than the LED driving voltage (about 6.8V). Meanwhile, when the capacitance of the input capacitor is decreased (FIG. 5B), the minimum output voltage (about 5.3 V) of the halogen lamp stabilizer is lower than the LED driving voltage (about 6.8 V). Consequently, there occurs a period in which the output voltage does not reach the level of the driving voltage. That is, the LED lamp can normally operate only when the minimum output voltage of the halogen lamp stabilizer is higher than the LED driving voltage.

However, when the capacitance of the capacitor is increased, the input current rises and a breakdown voltage of an internal element (for example, FET) increases, causing the element to be damaged. A certain driving circuit limits the input current. Thus, since a protection circuit operates when a current having a predetermined magnitude or more is inputted, the LED is not turned on. Therefore, according to the embodiment of the present invention, it is possible to ensure compatibility between the halogen lamp stabilizer and the LED lamp by increasing the capacitance of the capacitor to make the minimum output voltage of the halogen lamp stabilizer higher than the LED driving voltage. In addition, by installing the thermistor within the LED driving circuit, it is possible to prevent an overcurrent from flowing between the halogen lamp stabilizer and the AC-DC conversion unit. That is, by installing the thermistor 10 between the halogen lamp stabilizer and the LED driving circuit, overcurrent or inrush current due to the increased capacitance of the capacitor can be prevented. In addition, the internal circuit elements can be protected and the compatibility between the halogen lamp stabilizer and the LED lamp can be ensured, thereby stably driving the LED.

Figure 6A:
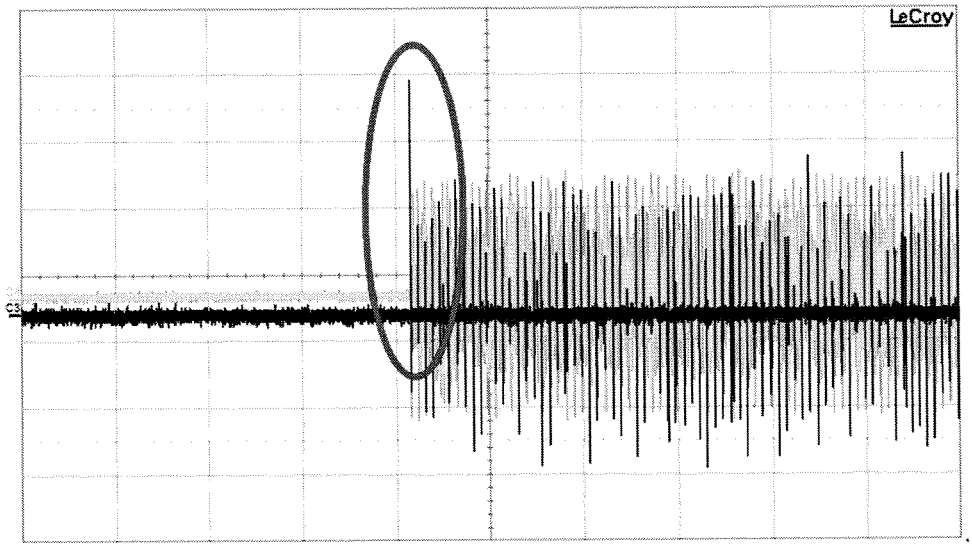
FIGS. 6A, 6B, 7A and 7B are stabilizer output waveform diagrams of a case in which a thermistor is applied and a case in which a thermistor is not applied.
Figure 6B:
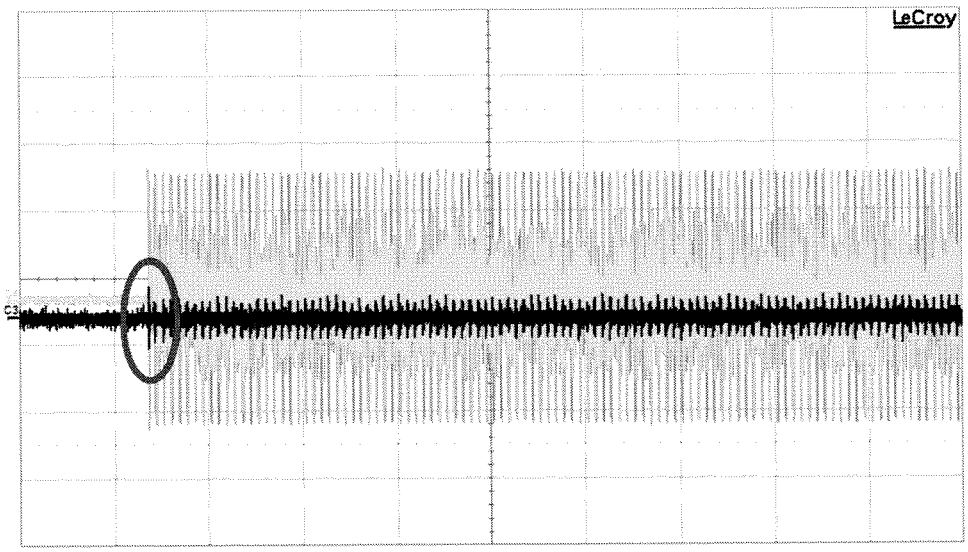

FIGS. 6 and 7 are stabilizer output waveform diagrams of a case in which a thermistor is applied and a case in which a thermistor is not applied. Specifically, FIG. 6A illustrates the case in which the thermistor is not applied, and FIG. 6B illustrates the case in which the thermistor is applied. As illustrated in FIG. 6A, when the thermistor is not applied, inrush current occurs excessively. Due to inrush current, internal elements may be damaged. In addition, due to the operation of the protection circuit, the LED may not be turned on. However, as illustrated in FIG. 6B, when the thermistor is applied, inrush current occurs only to a small extent.

Figure 7A:
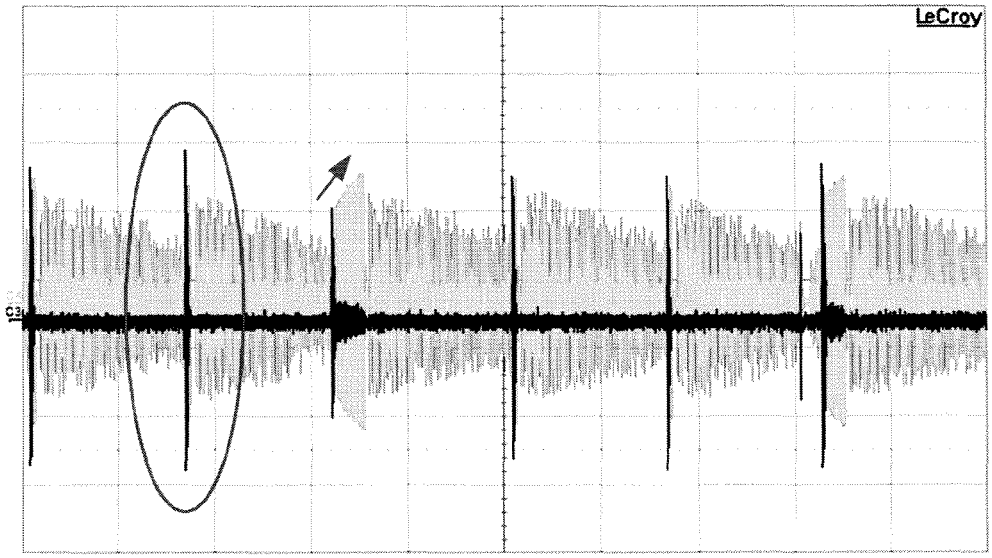
Figure 7B:
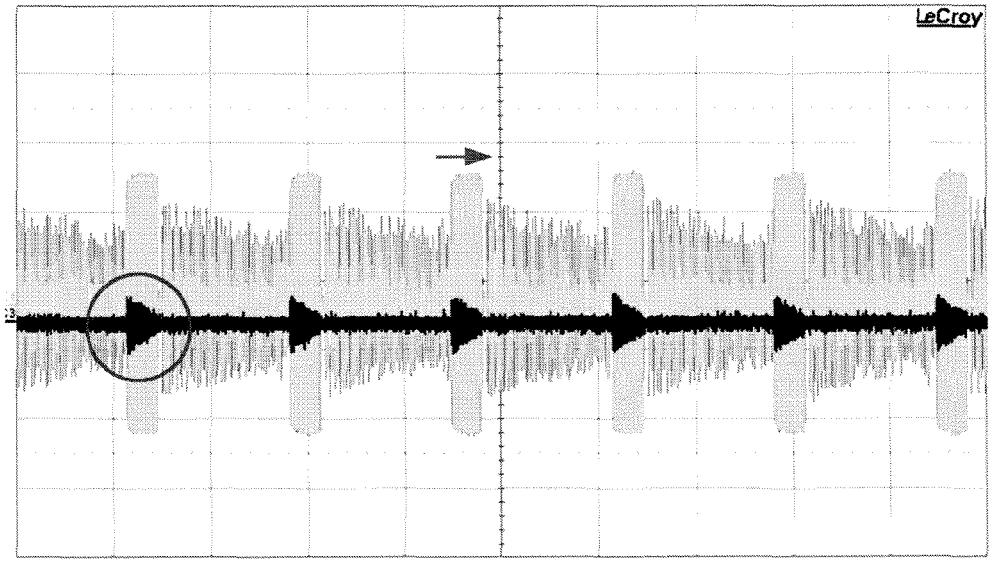

FIGS. 7A and 7B are stabilizer output waveform diagrams of a case in which a thermistor is applied and a case in which a thermistor is not applied. Referring to FIG. 7A, an output current instantaneously increases at a portion indicated by a circle. Thus, the output current is unstable and the output voltage is not constant and is unstable, as indicated by an arrow. On the other hand, referring to FIG. 7B, when the thermistor is applied, the stabilizer output voltage, indicated by arrows, is stable.

Figure 8A:
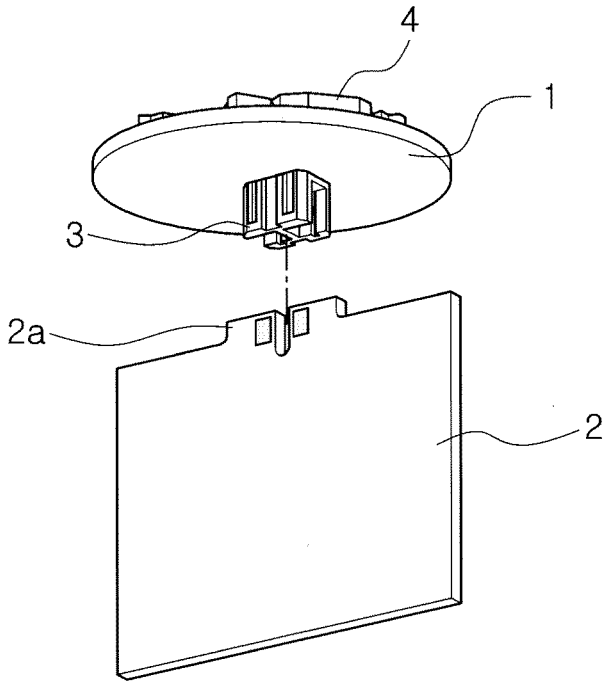
FIGS. 8A, 8B, 9 and 10 illustrate a structure of an LED lamp according to another embodiment of the present invention.
Figure 8B:
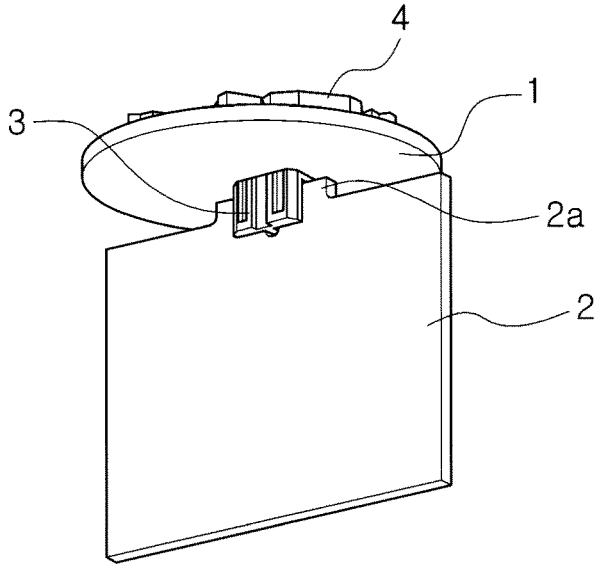
Figure 9:
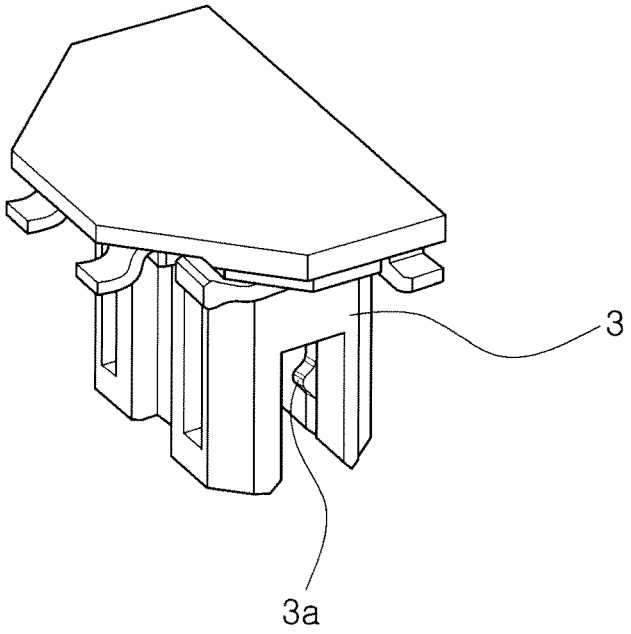
Figure 10:
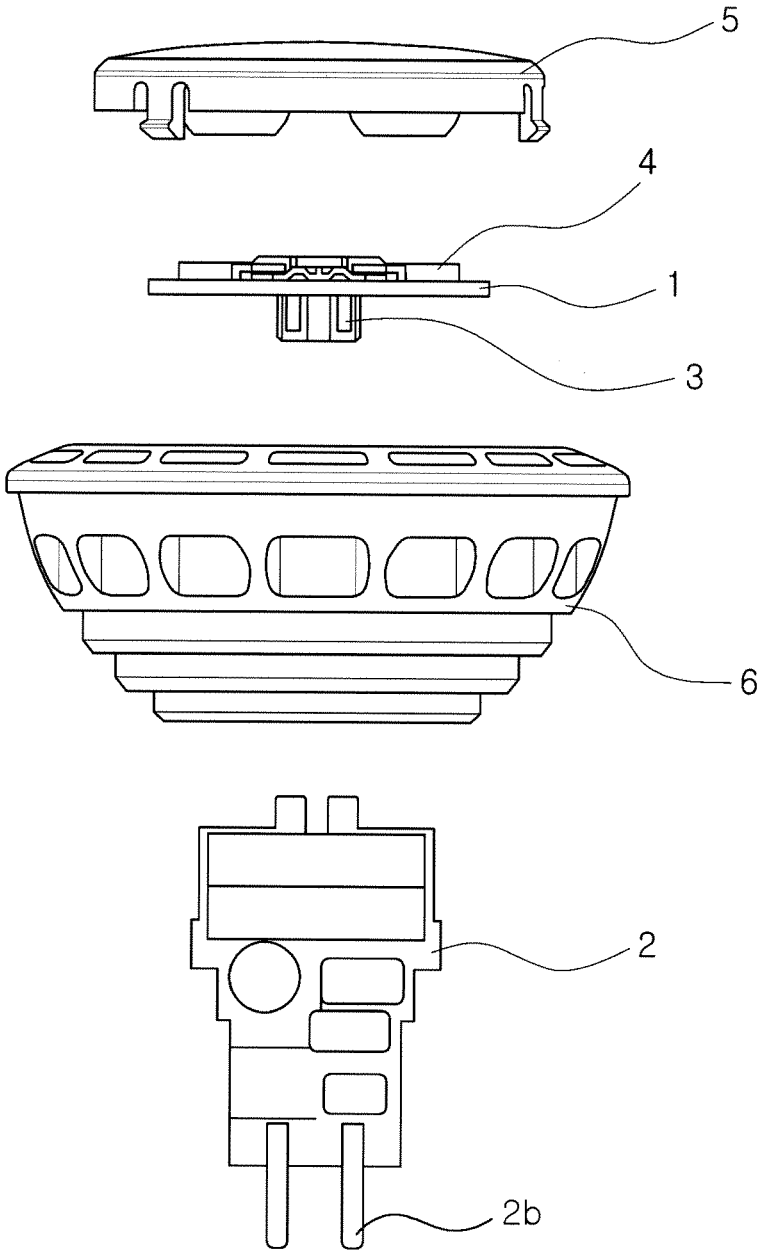

FIGS. 8 through 10 illustrate a structure of an LED lamp according to another embodiment of the present invention. FIG. 8A illustrates the structure of the LED lamp before an LED package board 1 and a control circuit board 2 are connected together, and FIG. 8B illustrates that the structure of the LED package board 1 and the control circuit board 2 are connected using a card edge connector 3. Referring to FIGS. 8A and 8B, the LED lamp according to the embodiment of the present invention includes the LED package board 1 on which at least one LED 4 is mounted, the control circuit board 2 on which a control circuit necessary for the operation of the LED 4 is mounted, and the card edge connector 3 connecting the LED package board 1 and the control circuit board 2.

Specifically, the control circuit necessary for the operation of the LED is mounted on the control circuit board 2. The control circuit board 2 includes terminals 2*a* electrically connected to the LED. The terminals 2*a* formed on the control circuit board 2 are electrically connected to connection terminals (not shown) formed within the card edge connector 3. The card edge connector 3 includes a groove into which the terminals of the control circuit board 2 are inserted. Therefore, the LED package board 1 on which the LED 4 is mounted and the control circuit board 2 on which the LED driving control circuit is mounted can be electrically connected together by the card edge connection between the terminals, without interconnect structures such as separate wires or harnesses. Since no additional soldering process is required, the manufacturing process of the LED lamp is simplified and the reliability of an LED lamp is improved. If necessary, it is easy to replace the LED package board 1 or the control circuit board 2.

FIG. 9 is a perspective view of the card edge connector. Referring to FIG. 9, the card edge connector 3 may have a top surface to be connected to the LED package board 1, and a groove to be connected to the control circuit board 2 through a card edge connection. At least one protrusion 3*a* may be formed inside the groove. The height of the protrusion 3*a* may be adjusted by the thickness of the control circuit board 2 to be inserted into the groove. That is, as the control circuit board 2 is inserted into the card edge connector 3, the protrusion 3*a* is pushed toward the inner wall surface by pressure applied by the control circuit board 2. As a result, since the width of the groove is adjusted according to the thickness of the control circuit board 2, the control circuit board 2 can be fixed within the card edge connector 3. Although not illustrated in detail, a terminal may be formed within the groove in order to electrically connect the control circuit board 2 to the LED package board 1 through the card edge connector 3.

FIG. 10 is an exploded perspective view of an LED lamp according to an embodiment of the present invention. The LED lamp according to the embodiment of the present invention may include an LED package board 1 on which at least one LED 4 is mounted, a control circuit board 2 on which an LED driving circuit is mounted, a card edge connector 3 coupling the control circuit board 2 to the LED package board 1, a heat sink 6 disposed between the LED package board 1 and the control circuit board 2, and a lens 5 disposed on a light emission surface of the LED package board.

As described above, the LED package board 1 and the control circuit board 2 may be inserted and connected together through the card edge connector 3 in a simple structure, without separate interconnection or soldering. The heat sink 6 dissipates heat from the LED to the outside. The heat sink 6 may be made of a metallic material having high heat conductivity in order for easier heat dissipation. In addition, a pin structure may be provided in order to increase the surface area of the heat sink 6. Meanwhile, the lens 5 may be disposed on the light emission surface of the LED 4 to determine an incident angle and a light distribution form. In addition, connection pins 2*a* to be connected to the external voltage may be further provided at a side of the control circuit board 2.

As set forth above, according to exemplary embodiments of the invention, the LED lamp driving circuit can stably drive the LED by ensuring the compatibility between the halogen lamp stabilizer and the LED lamp. The connection between the LED package board and the control circuit board can be improved. Therefore, the manufacturing process and inner structure of the LED lamp can be simplified.

While the present invention has been shown and described in connection with the exemplary embodiments, it will be apparent to those skilled in the art that modifications and variations can be made without departing from the spirit and scope of the invention as defined by the appended claims.

What is claimed is:

1. An LED lamp driving circuit comprising:

first and second driving circuit input terminals to which an external AC voltage configured to be generated by a halogen lamp stabilizer is applied;

a thermistor having a first terminal connected to the first driving circuit input terminal to which the external AC voltage is applied;

an AC-DC conversion unit having a first terminal connected to a second terminal of the thermistor and a second terminal connected to the second driving circuit input terminal such that the thermistor and AC-DC conversion unit are coupled in series between the first and second driving circuit input terminals, and wherein the AC-DC conversion unit converts the AC voltage into a DC voltage; and a DC-DC conversion unit converting the DC voltage from the AC-DC conversion unit into a DC voltage required to drive the LED lamp.

2. The LED lamp driving circuit of claim 1, wherein the DC-DC conversion unit is implemented in one of a boost type, a buck type, and a buck-boost type.

3. The LED lamp driving circuit of claim 1, wherein the DC-DC conversion unit is connected to an LED module including at least one LED.

4. An LED lamp comprising:

an LED package board on which at least one LED is mounted;

a control circuit board on which a control circuit required to operate the LED is mounted, terminals to be electrically connected to the LED being provided at a side of the control circuit board; and a card edge connector connecting the LED package board and the control circuit board, the card edge connector including a groove into which the terminals of the control circuit board are inserted.

5. The LED lamp of claim 4, wherein terminals to be electrically connected to the terminals of the control circuit board are provided within the groove of the card edge connector.

6. The LED lamp of claim 4, wherein one side of the card edge connector is connected to the LED package board, and the other side of the card edge connector is connected to the control circuit board, whereby the LED and the LED control circuit are electrically connected together.

7. The LED lamp of claim 4, wherein the card edge connector further includes a protrusion within the groove, and the protrusion fixes the control circuit board by adjusting the height of the protrusion according to the thickness of the control circuit board inserted into the card edge connector.

8. The LED lamp of claim 4, further comprising a heat sink between the LED package board and the control circuit board.

9. The LED lamp of claim 4, further comprising a connection pin which is provided at a side of the control circuit board and is to be connected to an external connection terminal.

10. The LED lamp driving circuit of claim 1, wherein the AC-DC conversion unit converts the AC voltage into a DC voltage at first and second output terminals of the AC-DC conversion unit, and the first and second output terminals are respectively connected to first and second input terminals of the DC-DC conversion unit.

* * * * *